US006841744B1

(12) United States Patent
Kodo et al.

(10) Patent No.: US 6,841,744 B1
(45) Date of Patent: Jan. 11, 2005

(54) SLIDE SWITCH AND MANUFACTURING METHOD OF THE SAME

(75) Inventors: Eiji Kodo, Fukui (JP); Yoshiharu Abe, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 28 days.

(21) Appl. No.: 10/404,092

(22) Filed: Apr. 2, 2003

(30) Foreign Application Priority Data

Apr. 4, 2002 (JP) ..... 2002-102345

(51) Int. Cl.[7] ..... H01H 21/54

(52) U.S. Cl. ..... 200/16 C; 200/16 D; 200/252; 200/547

(58) Field of Search ..... 200/16 C, 16 R, 200/16 D, 547, 549, 252

(56) References Cited

U.S. PATENT DOCUMENTS 4,115,670 A * 9/1978 Chandler ..... 200/5 R
4,210,791 A * 7/1980 Sorenson ..... 200/550
4,316,065 A * 2/1982 Rupp et al. ..... 200/61.89
4,395,609 A * 7/1983 Sowash ..... 200/342
4,491,703 A * 1/1985 Jaklic ..... 200/16 D
5,545,862 A * 8/1996 Takano et al. ..... 200/16 R
6,621,018 B1 * 9/2003 Chen ..... 200/16 C

FOREIGN PATENT DOCUMENTS

JP 8-115637 5/1996

* cited by examiner

*Primary Examiner*—Lincoln Donovan
*Assistant Examiner*—K. Lee
(74) *Attorney, Agent, or Firm*—Wenderoth, Lind & Ponack, L.L.P.

(57) ABSTRACT

A slide switch is fabricated by having a coiled spring, which has coil-end seating portions at both ends totaling ¾ to 1 turn, contained in a case or an operating member such that the operating member is biased by the spring. By virtue of such a configuration, the spring is prevented from bulging out at its center portion or coming off the containing portion. Thus, a slide switch which can be fabricated easily while also saving manpower can be provided.

2 Claims, 7 Drawing Sheets

SLIDE SWITCH AND MANUFACTURING METHOD OF THE SAME

TECHNICAL FIELD

The present invention relates to a slide switch for use in various electronic devices such as portable telephones and digital cameras and a method of manufacturing the same.

BACKGROUND ART

These days, slide switches of the so-called auto return type are widely used in various electronic devices such as portable telephones and digital cameras. The slide switches of this type are operable in two directions for changing a sound volume level or a zooming level, for example, and they return to a neutral position when the operation stops. Such a conventional switch will be described below with reference to FIG. 6 to FIG. 9.

FIG. 6 is a cross-sectional view of a conventional slide switch and FIG. 7 is an exploded perspective view of the same. Case 1 made of an insulating resin in a substantially box shape has a plurality of fixed contacts 2, made of a conducting metal, embedded in its inner side face in the back. On the interior bottom face of case 1, there are disposed rib-like press portions 1A extended from both side faces to oppose each other. Operating member 3 made of an insulating resin has an operating portion 3A forwardly projected from case 1 and a containing portion 3B recessed in the bottom face substantially in the center thereof. In containing portion 3B, there is contained a coiled spring 5 in its slightly pre-compressed state. On both left and right sides of containing portion 3B of operating member 3, there are provided groove portions 3C allowing press portions 1A of case 1 to be inserted therein. Accordingly, operating member 3 is housed in case 1 movably to the left and right. Movable contact piece 4 made of a metal has its center portion fixed to the back side face of operating member 3. Meanwhile, the movable contact piece 4 is slightly bent and has contact points 4A at both ends thereof, and is adapted to make contact with the side face in the back of case 1. Further, cover 6 made of a metal plate is disposed to cover the opening portion at the top of case 1 and thus the slide switch is completed.

Below will be described a method of manufacturing the slide switch as described above.

First, movable contact piece 4 is fixed to operating member 3. Then, while operating member 3 is held with containing portion 3B turned up, spring 5 is compressedly put into containing portion 3B. Then, operating member 3 is turned over and, while operating member 3 is held such that containing portion 3B containing spring 5 faces downward, operating member 3 is put into case 1. Finally by covering the opening portion at the top of case 1 with cover 6, fabrication of the slide switch is completed.

In the above described configuration, when operating portion 3A is moved to the left from the neutral position shown in FIG. 6, the left-hand end of spring 5 gets off the left-hand side face of containing portion 3B with movement of operating member 3 as shown in FIG. 8. At this time, spring 5 is adapted to make contact with press portion 1A on the left-hand side of case 1, and hence, by being pressed thereby against the right-hand side face of containing portion 3B, spring 5 comes to be compressed. Meanwhile, contact points 4A at both ends of movable contact piece 4 fixed to operating member 3 are allowed to resiliently slide along the side face in the back of case 1, whereby the contact points are adapted to make contact with fixed contacts 2 on the left-hand side and in the center. Thus, an electrical connection by the switch is performed via movable contact piece 4. When the operating force on operating portion 3A is released, the right-hand end of spring 5 presses the right-hand side face of containing portion 3B. Then, the biasing force of compressed spring 5 causes operating member 3 to return to its neutral position. When, operating portion 3A is moved in the direction to the right, spring 5 is compressed, oppositely, between press portion 1A on the right-hand side of case 1 and the left-hand side face of containing portion 3B. Hence, contact points 4A of movable contact piece 4 are adapted to make contact with fixed contacts 2 in the center and on the right-hand side.

In the above described conventional slide switch, however, coiled spring 5 generally has ¼ turn of coil-end seating portion 5A at each end thereof as indicated by the hatched portions in FIG. 9. Therefore, the lower half of spring 5 is longer than the upper half corresponding to coil-end seating portions 5A. Accordingly, when spring 5 is compressedly put into containing portion 3B of operating member 3 in assembling work of the switch, coil-end seating portions 5A are adapted to make contact with side faces on the left and right of containing portion 3B and, hence, spring 5 cannot be uniformly compressed. Thus, the center portion of spring 5 bulges upward to cause spring 5 to easily jump off containing portion 3B and come out of position. This makes the assembling work difficult and hence much time is required for assembly.

SUMMARY OF THE INVENTION

A slide switch of the present invention comprises a case with a plurality of fixed contacts embedded therein, an operating member movably housed in the case, a movable contact piece fixed to the operating member and adapted to be connected to and disconnected from the fixed contacts, and a coiled spring contained in the containing portion of the case or the operating member for biasing the operating member. The spring has coil-end seating portions at both ends totaling at least ¾ turn and at most 1 turn.

DETAILED DESCRIPTION OF PREFERRED EMBODIMENTS

A preferred embodiment of the present invention will be described with reference to FIG. 1 to FIG. 5.

Figure 1:
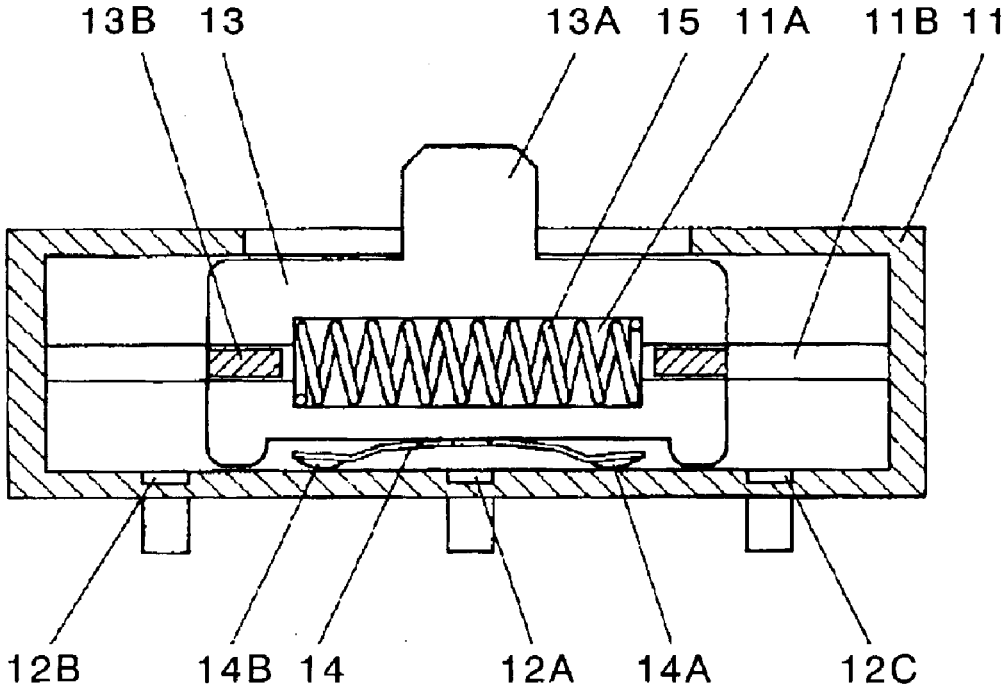
FIG. 1 is a sectional view of a slide switch according to an embodiment of the present invention.
Figure 2:
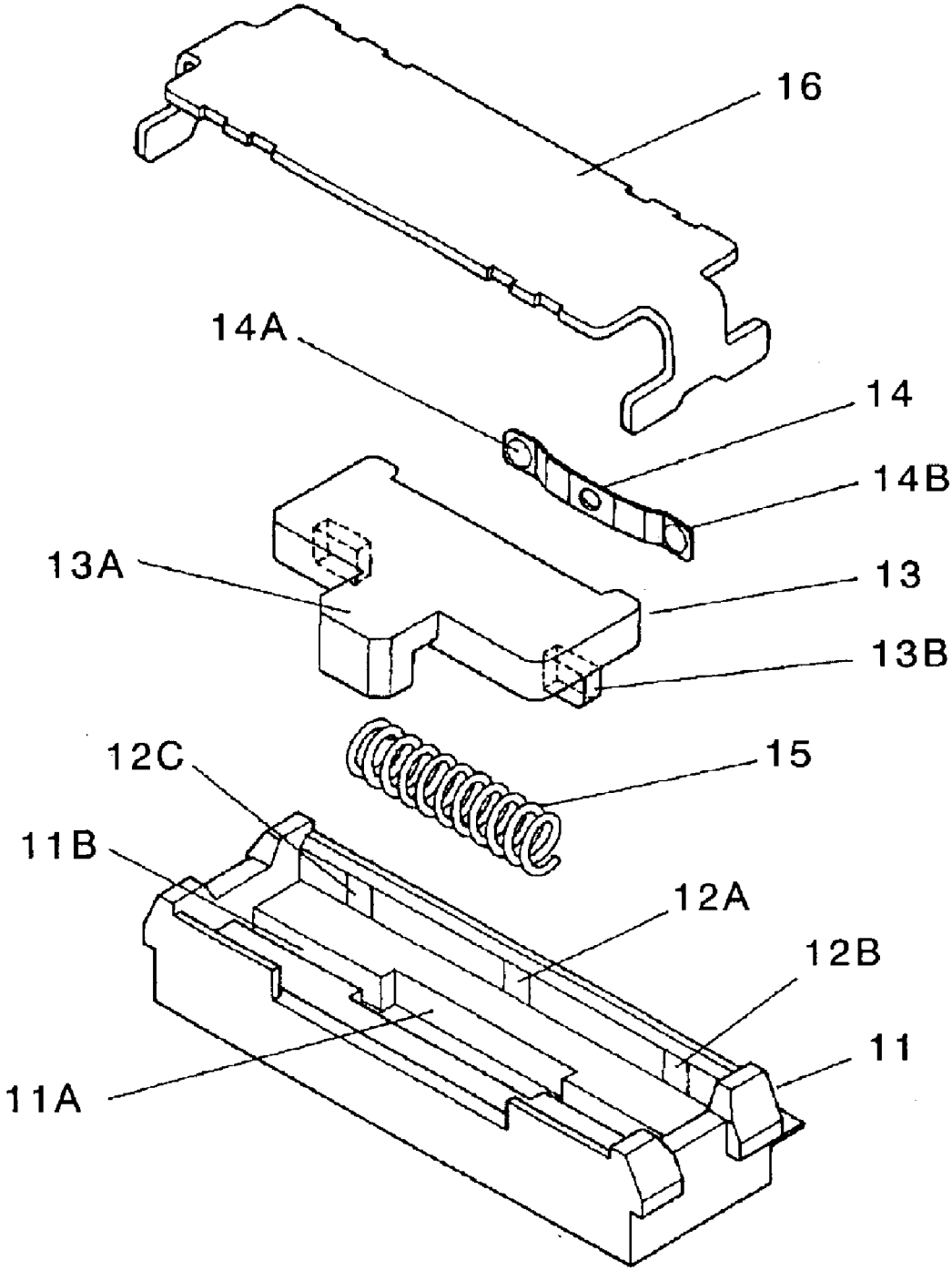
FIG. 2 is an exploded perspective view of the slide switch according to the embodiment of the invention.

FIG. 1 is a cross-sectional view of a slide switch according to the preferred embodiment of the invention and FIG. 2 is an exploded perspective view of the same. Case 11 is formed in a substantially box shape and made of an insulating resin such as polyphenylene-sulfite or polybutylene-telephthalate. In the interior face in the back of case 11, there are embedded a plurality of fixed contacts 12A–12C made of a metal such as copper alloy or the like plated with a noble metal such as silver.

Within a containing portion 11A provided by a recess in the interior bottom face of case 11, there is contained a spring 15, made of copper wire or the like in a coil shape, slightly compressed along the length. At both ends of containing portion 11A, there are provided groove portions 11B extended in both leftward and rightward directions.

Operating member 13 is made of an insulating resin such as polybutylene-telephthalate or nylon. Operating member 13 has an operating portion 13A forwardly projected from case 11 and press portions 13B in a rib shape disposed at both ends to oppose each other. Press portions 13B are inserted in groove portions 11B such that operating member 13 is movable in the leftward and rightward directions within case 11.

Movable contact piece 14 is made of a metal such as copper alloy or the like plated with a noble metal such as silver. The center portion of movable contact piece 14 is fixed to the side face of in the back of operating member 13. Movable contact piece 14 is slightly bent and has contact points 14A and 14B at both ends thereof, and is adapted to make contact with the side face in the back of case 1.

By covering the opening portion at the top of case 11 containing operating member 13 with a cover 16 made of metal such as steel plate, the slide switch is completed.

Figure 3:
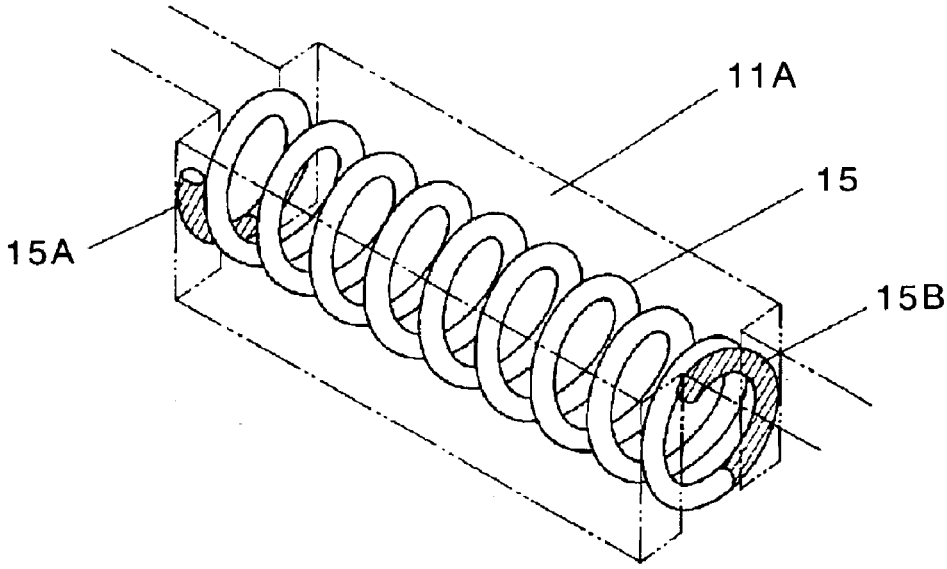
FIG. 3 is a perspective view of a spring used in the slide switch according to the embodiment of the invention.

In this case, coiled spring 15 has, as indicated by the hatched portions in the perspective view of FIG. 3, coil-end seating portion 15A of ¼ turn at the left-hand end, while it has coil-end seating portion 15B of ½ to ¾ turn at the right-hand end. Hence, the sum total of the number of turns of the coil-end seating portions at both ends comes to ¾ to 1 turn, which means that the lengths of the upper half and the lower half of the spring are substantially equal, no matter how the spring is radially oriented around the center axis. Accordingly, regardless of the positions at which the spring is adapted to contact with the side faces on the left and right of containing portion 11A, the spring is uniformly compressed and never bulges at its center portion or comes off containing portion 11A.

The slide switch in the configuration as described above is fabricated in the following way. First, spring 15 slightly pre-compressed is inserted into containing portion 11A of case 11. Then, operating member 13 with movable contact piece 14 fixed to its back side face is held such that press portions 13B are turned down and this operating member 13 is mounted on case 11 such that spring 15 within containing portion 11A is placed between press portions 13B on the left-hand and right-hand sides.

Finally, by mounting cover 16 on the top face of case 11, the slide switch is completed.

Figure 4:
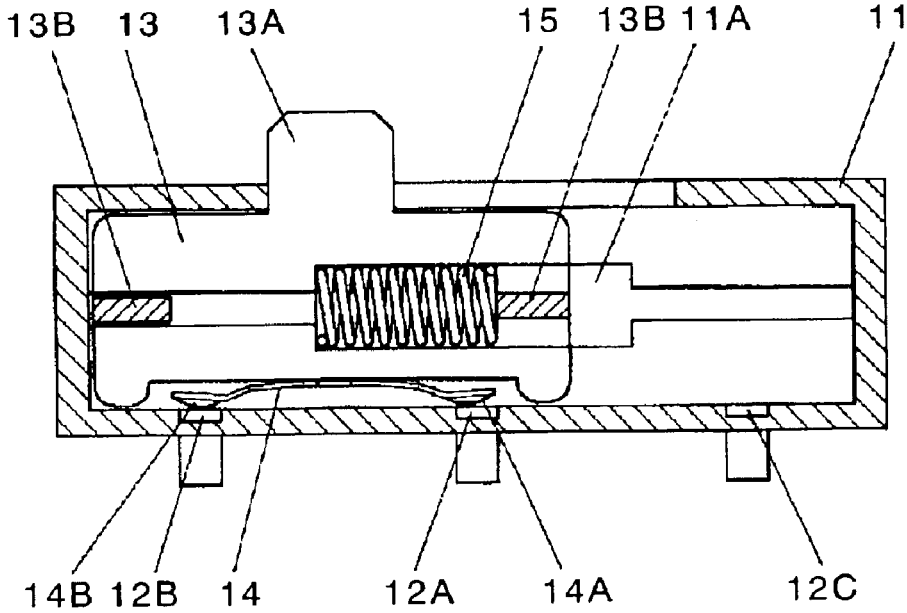
FIG. 4 is a sectional view of the slide switch under operating conditions of the slide switch of the invention.

When operating portion 13A of the slide switch structured as described above is moved in the direction to the left from the neutral position indicated in FIG. 1, spring 15 is compressed, as shown in FIG. 4, with one end thereof making contact with the left-hand end of containing portion 11A of case 11 and with the other end thereof pressed by press portion 13B on the right-hand side. At the same time, contact points 14A and 14B of movable contact piece 14 fixed to the face of operating member 13 resiliently slide over the inner face of case 11 and come into contact with fixed contacts 12A and 12B in the center and on the left-hand side. Thus, fixed contacts 12A and 12B are electrically connected via movable contact piece 14.

When the operating force applied to operating portion 13A is released, operating member 13, together with movable contact piece 14, returns to the neutral position due to the biasing force of compressed spring 15 so that the electrical connection between fixed contacts 12A and 12B is broken.

When operating portion 13A is moved in the rightward direction, electrical connection between the fixed contacts 12A and 12C in the center and on the right-hand side is made with movement of movable contact piece 14 to the right, analogous to the case where operating portion 13A is moved in the leftward direction. When the operating force is released, operating member 13 is returned to the neutral position by the biasing force of spring 15.

According to the present embodiment as described above, coiled spring 15 having a total of ¾ to 1 turn of coil-end seating portions at both ends is contained in containing portion 11A of case 11 and operating member 13 is biased by this spring 15. By virtue of the described configuration, the upper half and the lower half of spring 15 become substantially equal in length, no matter how the spring is radially oriented around the center axis. Hence, the spring is uniformly compressed regardless of the positions at which the spring is adapted to make contact with the left-hand and right-hand side faces of containing portion 11A. Thus, since the spring never bulges at its center portion or comes off containing portion 11A, a method of fabricating slide switches easily while also saving manpower can be provided.

Figure 5:
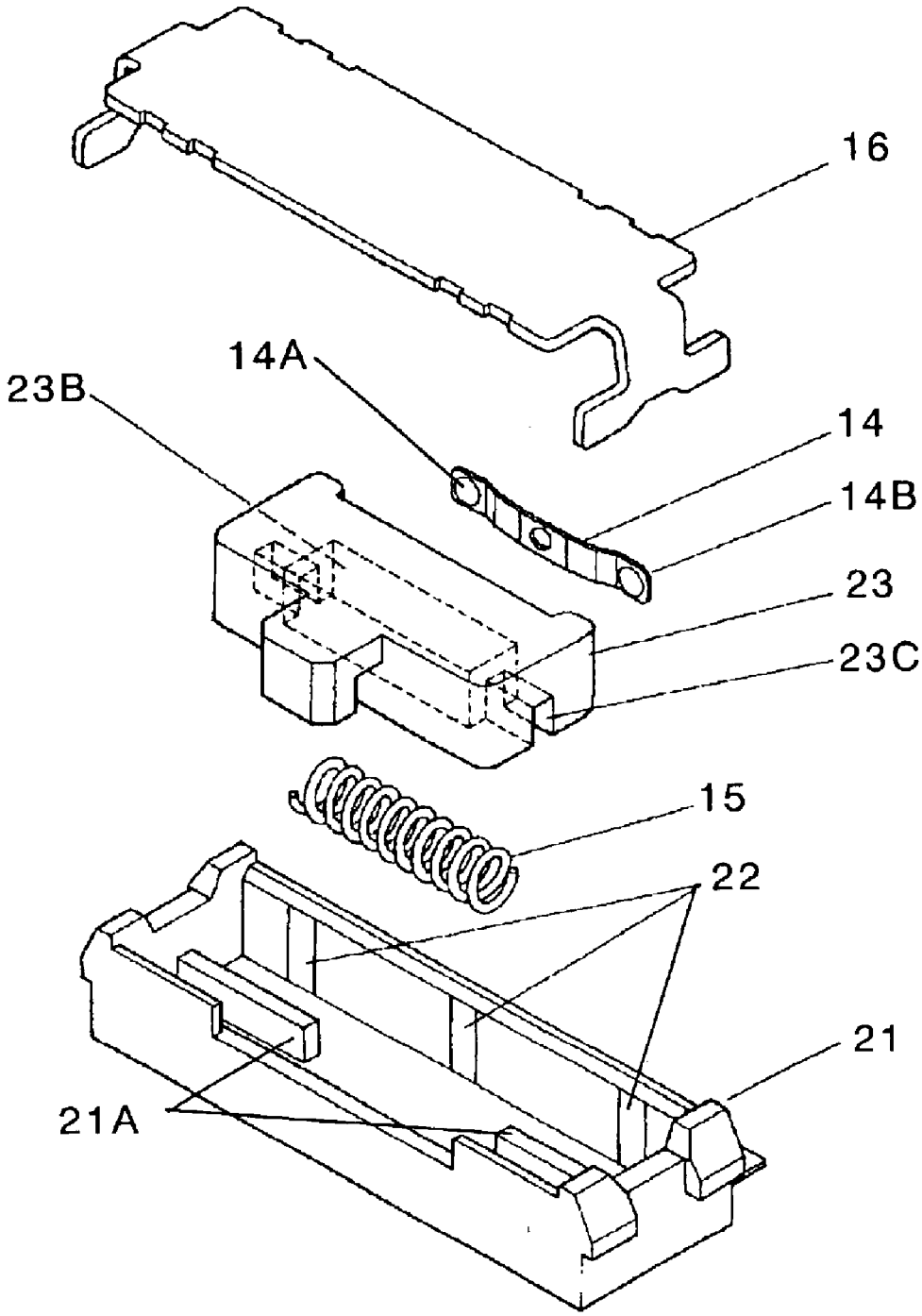
FIG. 5 is an exploded perspective view of a slide switch according to another embodiment of the invention.
Figure 6:
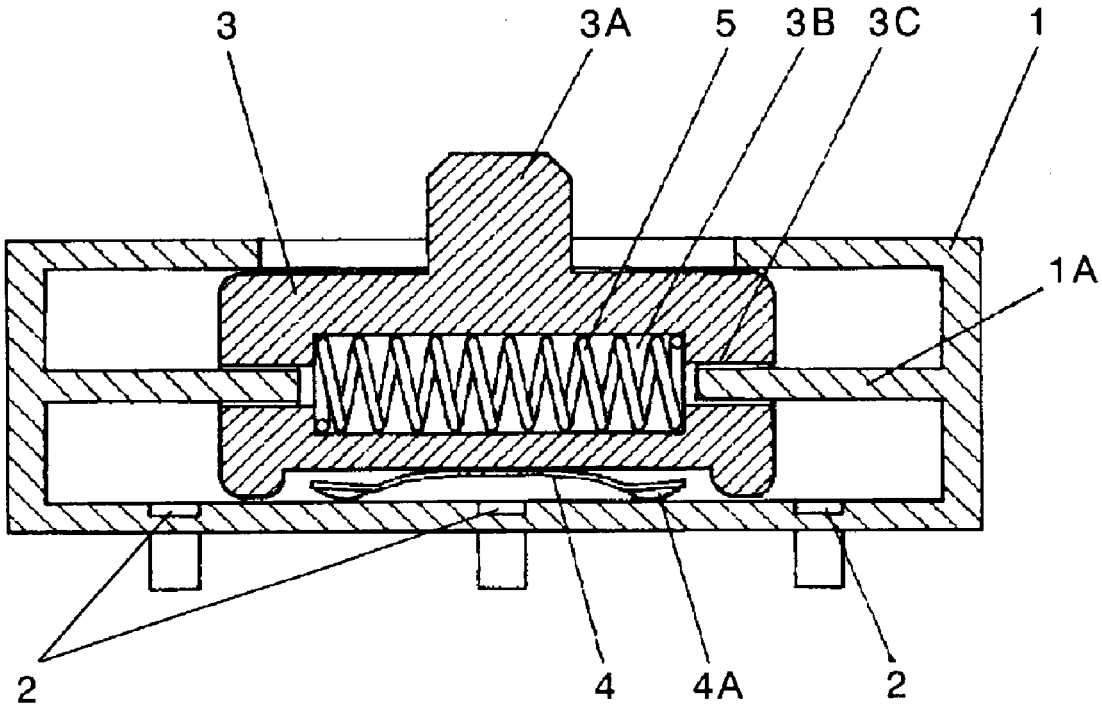
FIG.6 PRIOR ART
FIG. 6 is a sectional view of a conventional slide switch.
Figure 7:
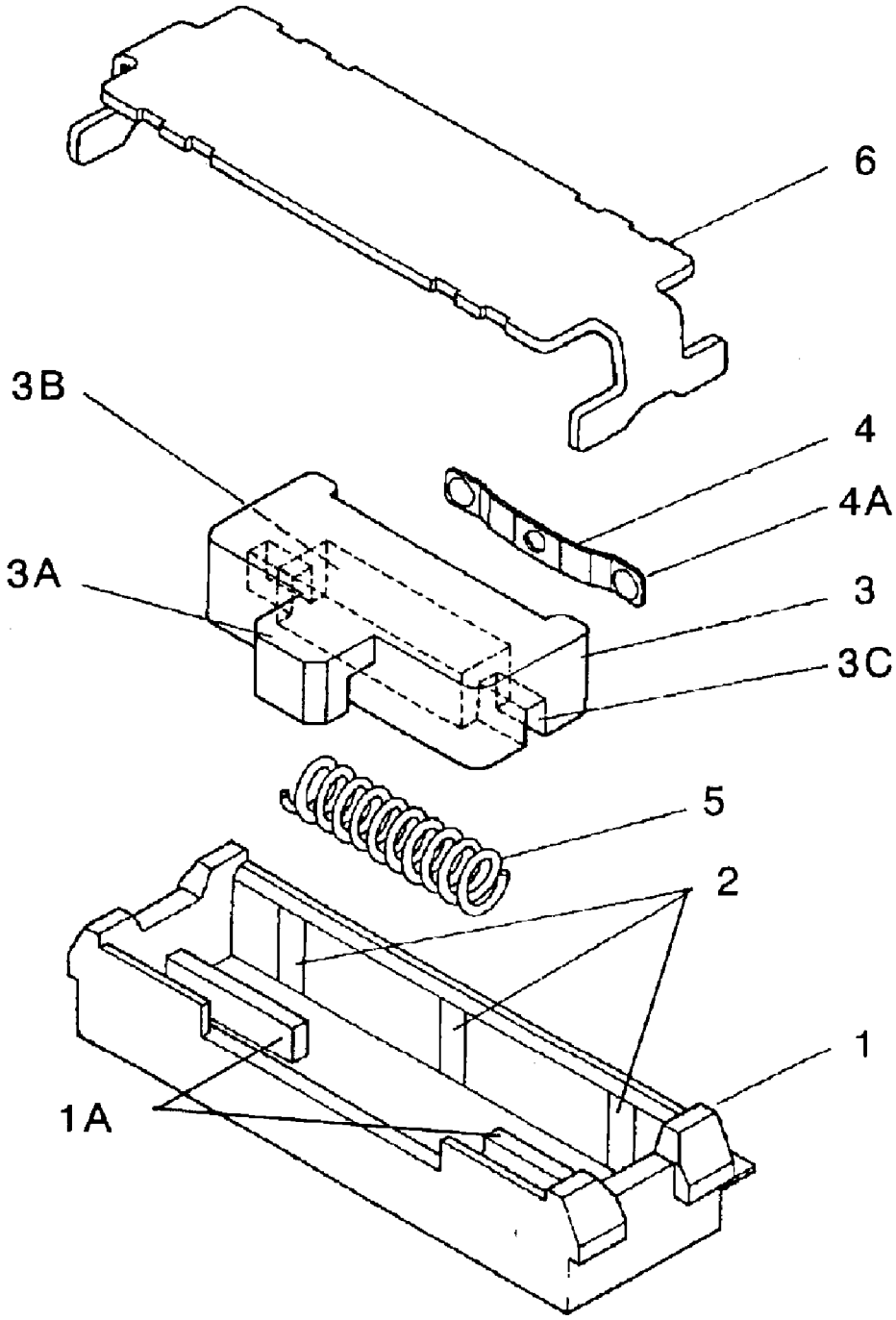
FIG.7 PRIOR ART
FIG. 7 is an exploded perspective view of the conventional slide switch.
Figure 8:
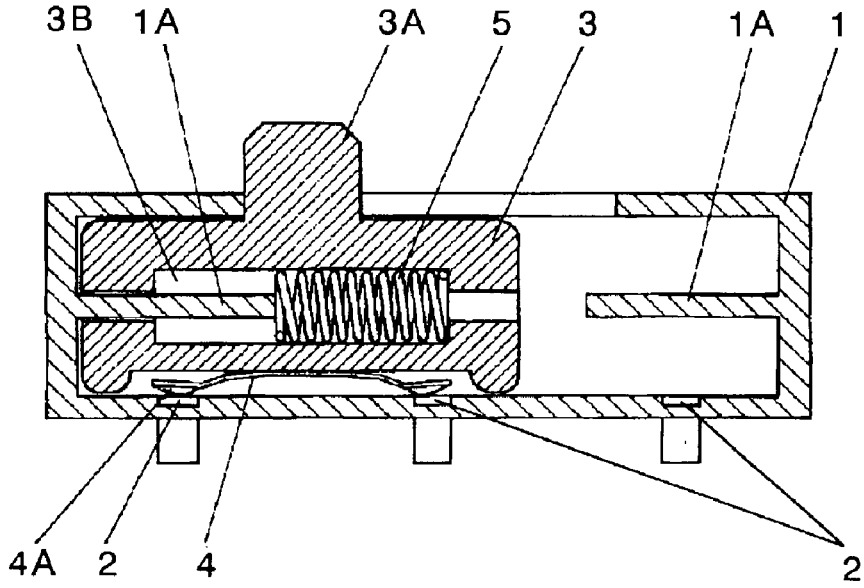
FIG.8 PRIOR ART
FIG. 8 is a sectional view of the conventional slide switch under operating conditions.
Figure 9:
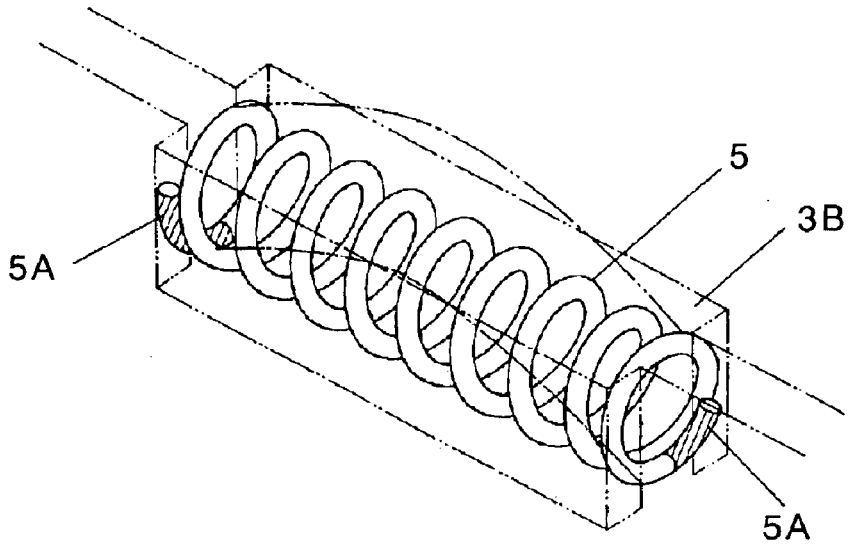
FIG.9 PRIOR ART
FIG. 9 is a perspective view of a spring used in the conventional slide switch.

In the description given above, the slide switch is designed such that spring 15 is contained in containing portion 11A of case 11 and the spring 15 is compressed by press portion 13B of operating member 13. However, the present invention can also be embodied, as shown in FIG. 5, by having spring 15 contained in containing portion 23B provided in the center of the bottom face of operating member 23 and allowing spring 15 to be compressed by rib-like press portions 21A provided in the interior bottom face of case 21. Also in this case movable contact piece 14 is adapted to make contact with fixed contacts 22 to make electrical connection.

When containing portion 11A is provided in case 11 as shown in FIG. 1 and FIG. 2, fabrication can be performed by using case 11 as the base and mounting thereon spring 15, operating member 13 with movable contact piece 14 fixed thereto, and cover 16 one after another. This method eliminates the need for turning over the operating member 13 when the spring 15 is set in place, as is needed in the case of FIG. 5 where containing portion 23B is provided in operating member 23. Hence assembling work can be made easier.

In the above description of the present embodiment, coil-end seating portion 15A at the left-hand end of spring 15 was described to be provided by ¼ turn and coil-end seating portion 15B at the right-hand end is described to be provided by ½ to ¾ turn. The distribution of the number of turn of the coil-end seating portions at both ends is not limited but it is enough if the sum of the total number of turns at both ends is at least ¾ turn and at most 1 turn.

Further, case 11, 21 was described above to be made of an insulating resin such as polyphenylene-sulfite or polybutylene-telephthalate and operating member 13, 23 to be made of an insulating resin such as polybutylene-telephthalate or nylon. However, another resin material, ceramic material, or the like may be used if the material is an insulating material having strength withstanding the resilience of spring 15.

What is claimed is:

1. A slide switch comprising:

a case with fixed contacts embedded therein;

an operating member movably contained in said case;

a movable contact piece fixed to said operating member and arranged to be connected to and disconnected from said fixed contacts;

a containing portion provided in one of said case and said operating member, said containing portion having a pair of inner side faces disposed perpendicular to a moving direction of said operating member; and a coiled spring contained in said containing portion and operable to apply a biasing force to said operating member, said spring being arranged to make contact with said pair of inner side faces, wherein said spring is provided at a first end thereof with a first coil-end seating portion, wherein said spring is provided at a second end thereof with a second coil-end seating portion, and wherein a total sum of a number of turns of said first coil-end seating portion and said second coil-end seating portion is at least ¾ turn and at most 1 turn.

2. A method of manufacturing a slide switch comprising:

placing a coiled spring operable to apply a biasing force to an operating member in a containing portion provided in one of a case with fixed contacts embedded therein and said operating member movable within said case, said spring being arranged to make contact with a pair of inner side faces of said containing portion, and said pair of inner side faces being disposed perpendicular to a moving direction of said operating member;

fixing a movable contact piece, to be connected to and disconnected from said fixed contacts, to said operating member; and placing said operating member in said case, wherein said spring is provided at a first end thereof with a first coil-end seating portion, wherein said spring is provided at a second end thereof with a second coil-end seating portion, and wherein a sum of a total number of turns of said first coil-end seating portion and said second coil-end seating portion of said spring is at least ¾ turn and at most 1 turn.

* * * * *